US007545335B1

(12) United States Patent
Wang

(10) Patent No.: US 7,545,335 B1
(45) Date of Patent: Jun. 9, 2009

(54) SMALL CONFORMABLE BROADBAND TRAVELING-WAVE ANTENNAS ON PLATFORM

(75) Inventor: Johnson J. H. Wang, Marietta, GA (US)

(73) Assignee: Wang Electro-Opto Corporation, Marietta, GA (US)

( * ) Notice: Subject to any disclaimer, the term of this patent is extended or adjusted under 35 U.S.C. 154(b) by 0 days.

(21) Appl. No.: 12/046,894

(22) Filed: Mar. 12, 2008

(51) Int. Cl.
*H01Q 13/10* (2006.01)

(52) U.S. Cl. ..... 343/770; 343/768; 343/853

(58) Field of Classification Search ..... 343/768, 343/770, 853, 860
See application file for complete search history.

(56) References Cited

U.S. PATENT DOCUMENTS

| | | | | |
|---|---|---|---|---|
| 4,112,431 | A * | 9/1978 | Wild | 343/768 |
| 5,313,216 | A | 5/1994 | Wang et al. | |
| 6,137,453 | A | 10/2000 | Wang et al. | |
| 7,106,270 | B2 * | 9/2006 | Iigusa et al. | 343/833 |
| 2008/0316124 | A1 * | 12/2008 | Hook | 343/705 |

OTHER PUBLICATIONS

Chu, L. J., "Physical Limitations of Omnidirectional Antennas," J. Appl. Phys., vol. 19, Dec. 1948.

Deschamps, G. A. "Impedance Properties of Complementary Multiterminal Planar Structure," IEEE Trans. Antennas and Prop. vol. 7, No. 5, pp. S371-S378, Dec. 1959.

DuHamel, H. D., et al., "Frequency Independent Antennas," in Antenna Engineering Handbook, 3rd ed., R. C. Johnson, Editor, McGraw-Hill, New York, 1993, Chpt. 14.

Mayes, P. E., "Frequency Independent Antennas," in Antenna Handbook, Y. T. Lo and S. W. Lee, Editors, Van Nostrand Reinhold, NY, 1988., Chpt. 9.

Matthaei, G., L. Young, et al., "Microwave Filters, Impedance-Matching . . . Structures", McGraw-Hill, NY, 1964, reprinted by Artech House, Norwood, MA in 1985, Chptr. 11.

Wang, J. J. H., Generalized Moment Methods in Electromagnetics—Formulation and Computer Solution of Integral Equations, Wiley, NY, 1991, pp. 103-105, 165-175.

Wang, J. J. H., "The Spiral as a Traveling Wave Structure for Broadband Antenna Applications," Electromagnetics, 20-40, Jul.-Aug. 2000.

Wang, J. J. H., "A Critique and New Concept on Gain Bandwidth Limitation of Omnidirectional Antennas," Progress in Electromagnetics Res. Symp. (PIERS) 2005, Hangzhou, CN, Aug. 2005.

Wang, J. J. H., "Fundamental Bandwidth Limitation for Small Antennas on a Platform," IEEE IWAT 2006): Small Antennas and Novel Metamaterials, White Plains NY, Mar. 2006.

(Continued)

*Primary Examiner*—Hoang V Nguyen
(74) *Attorney, Agent, or Firm*—Thomas, Kayden, Horstemeyer & Risley, LLP

(57) ABSTRACT

The invention is a novel solution to circumvent the fundamental gain bandwidth limitations of an antenna of a given size by using a traveling-wave (TW) antenna and strongly coupling it with the mounting platform to enlarge the effective size of the antenna. A preferred form of this invention comprises a conducting ground surface generally curvilinear and conformal to said platform, a broadband TW surface radiator positioned above and spaced apart from said ground surface, an impedance matching structure between the surface radiator and the conducting ground surface, and a reactive impedance matching network positioned on the periphery of said surface radiator.

12 Claims, 6 Drawing Sheets

A-A' Cross-sectional View

OTHER PUBLICATIONS

Wang, J. J. H., et al., "Broadband/Multiband Conformal Circular Beam-Steering Array," IEEE Trans. Antennas and Prop. vol. 54, No. 11, pp. 3338-3346, Nov. 2006.

Wang, J. J. H. and V. K. Tripp, "Design of Multioctive Spiral-Mode Microstrip Antennas," IEEE Trans.Ant. Prop., Mar. 1991.

* cited by examiner

SMALL CONFORMABLE BROADBAND TRAVELING-WAVE ANTENNAS ON PLATFORM

STATEMENT REGARDING FEDERALLY SPONSORED RESEARCH OR DEVELOPMENT

This invention was conceived and created by the inventor without external financial support. The inventor chose to assign all the rights to Wang Electro-Opto Corporation. Wang Electro-Opto Corporation chose to grant to the U.S. Department of Defense (DoD) the right for royalty-free usage similar to the terms and conditions of DoD SBIR (Small Business Innovation Research) program in recognition of the product development effort later using this invention under a DoD SBIR contract No. H92222-07-C-0071 sponsored by U.S. Special Operations Command, MacDill AFB, FL 33621.

TECHNICAL FIELD

The present invention is generally related to radio-frequency antennas and, more particularly, small conformal broadband antennas on curved platform.

BACKGROUND OF THE INVENTION

Small broadband antennas conformable to curved platforms have become increasingly more important for both military and commercial applications. The broadband requirement is driven by the proliferation of wireless systems and the need for high speed. The smallness of an antenna is measured by its operating free-space wavelength; generally, an antenna is electrically small if its largest dimension is less than ½ free-space wavelengths, especially if a broad bandwidth, say, over 20%, is required. The conformability feature, defined as having minimal protrusion and intrusion to the surface of the platform on which the antenna is mounted, is desirable and even necessary, especially for airborne platforms.

Now, broadband and smallness/conformability are inherently conflicting requirements for antennas. The bandwidth of an antenna is limited by its size, shape, and the interference of proximate objects. Although the class of frequency-independent (FI) antenna had been invented from late 1950s through 1960s, and was well documented in the literature (e.g., DuHamel and Scherer, 1993; Mayes, 1988), these antennas were designed with no reference to their conformability nor their mounting platform, both of which restrict the size and shape, as well as the radiation property, of the antenna. Note that an antenna is necessarily connected with a feed cable and a transceiver, which is a de facto platform that cannot be ignored, especially if the platform (and consequently the antenna) is electrically small.

Around 1970, a conformal antenna called the microstrip patch antenna was invented, which has a ground plane as part of its design and is thus amenable to mounting on a platform with a conducting or nonconducting surface. Unfortunately the microstrip patch antenna is a narrowband antenna. It took another two decades before a broadband version was invented. It was the spiral-mode microstrip (SMM) antenna (Wang and Tripp, 1991; Wang and Tripp, 1994). Since 1990, significant progress has been made in the SMM antenna (Wang, 2000; Wang et al, 2006); and additional techniques using planar FI antennas, notably the miniaturized slow-wave (SW) antenna (Wang and Tillery, 2000), have been developed. In addition to an octaval bandwidth of up to 10:1 or more, the multiplicity of radiation features in these antennas provide the unique capability of multifunction, such as dual-polarization, rarely available in other antennas.

A common feature of these patented designs, from the microstrip patch antenna to SMM antenna to SW antenna, is the inclusion of a fairly planar ground plane placed very close to, and parallel to, a fairly planar surface radiator. The inclusion of a conducting ground plane in these antennas makes them amenable to conformal mounting on the surface of a platform such as an airplane or a ground vehicle. However, for a platform that is irregularly shaped, and/or has a small size and a small radius of curvature (in terms of the operating wavelength), these antennas have thus far been unable to satisfy most conformability requirements.

Additionally, the gain bandwidth of an antenna is fundamentally limited by its electrical size (namely, size in wavelength); thus broadband is difficult to achieve when the antenna is electrically small. This theory on antenna gain-bandwidth limitation due to the antenna size was developed by Chu six decades ago (1948). Since then, many prominent scholars in electromagnetic theory have visited and revisited this problem, and all with confirming findings. Today, the Chu equation for the gain-bandwidth limitation of an antenna of a given size remains essentially intact.

Recently, this inventor noted some major shortcomings and ambiguities in the Chu theory when applied to real-world problems (Wang, August 2005; Wang, March 2006). These severe shortcomings of the Chu theory are rooted in its basic assumptions which are overly narrow and incompatible with most real-world problems. First, an antenna is rarely an object isolated in space; its specific size becomes ambiguous when it is mounted on a platform. Since an antenna is always connected to a transmission line feeding a transceiver, its extent and size become ambiguous, especially if it is electrically small. In fact, in some designs of electrically small antennas the main radiator is the platform or transceiver, not the antenna per se.

Second, in the Chu theory the antenna problem was formulated restrictively (strictly speaking, inadequately) as an antenna with an external matching network, with single-port connections between them and the transceiver. The employment of a matching structure in the antenna aperture or the use of multiple ports would present a problem not subject to the Chu limitation.

Third, the Chu theory is applicable only to high-Q (quality factor) narrowband antennas because it is based on the inverse relationship between Q and bandwidth, which rapidly becomes invalid as Q decreases below about 4. Thus, the Chu theory breaks down for broadband (low Q) antennas which are typically of the non-resonant type.

Fourth, the unrealistic assumption of zero dissipative loss makes it unamenable to the design approach which optimizes gain-bandwidth at a small sacrifice of dissipative loss.

This inventor reported in the two papers cited earlier that conformal traveling-wave (TW) antennas, such as the SMM antenna and the SW antenna, are not subject to the overly restrictive Chu limitation. For these conformal TW antennas, octaval bandwidth (defined as the ratio of the upper bound and lower bound of the operating bandwidth) over 10:1, and exceeding the Chu limitation, is feasible. The practical bandwidth limitation on the upper frequency bound is largely due to its radiation property (pattern and polarization); and at its lower frequency bound is due to its impedance.

However, these conformal TW antennas exceeding the Chu limitation are confined to the SMM antenna and the SW antenna, both of which have a conducting ground plane and a radiator fairly planar and spaced a constant distance apart.

Recently, this inventor conceived the present invention, which potentially has superior performance and/or form factor over prior-art approaches.

Additionally, the present invention is an innovation which achieves broadband and conformability for a given platform of small size and curved surface, and also reduces the size of the antenna by coupling the traveling wave to the surface of the platform to effect radiation at the lower end of the operating frequencies.

SUMMARY OF THE INVENTION

The novelty of the invention is in its elegant solution to circumvent the fundamental gain bandwidth limitations of an antenna of a given size and shape. The invention stems from a profound realization of the shortcomings of the well established theory on this topic. By using a traveling-wave antenna and strongly coupling it with the platform on which the antenna is mounted, the effective size of the antenna is enlarged and thus the antenna gain bandwidth is enhanced. This invention is to overcome the frequency bandwidth limitations, especially the lower bound of the frequency, in antennas mounted on a platform.

The present invention is an electrically small conformal broadband antenna for mounting on a curved platform. (As used hereafter, "electrically small" in antenna theory generally refers to a linear dimension that is ½ free-space wavelength or shorter. Thus an "electrically small antenna" refers to an antenna whose maximum linear dimension is ½ free-space wavelength or shorter.) Its low profile and conformal shape makes it amenable to mounting or integration onto a curved platform of small radius of curvature with minimal intrusion and/or protrusion. The antenna and its mounting platform are collectively addressed and designed as the antenna/platform assembly, achieving the features of broadband, conformability and smallness, taking advantage of the interactions between the antenna and its mounting platform, especially when the maximum dimension of the antenna is smaller than, say, ½ wavelength. A preferred form of this invention comprises a conducting ground surface generally curvilinear and conformal to said platform, a broadband traveling-wave (TW) surface radiator positioned above and spaced apart from said ground surface, an impedance matching structure between the surface radiator and the conducting ground surface, and a reactive impedance matching network positioned on the periphery of said surface radiator.

The surface radiator consists of an array of slots and is generally curvilinear and spaced apart from said ground surface more than 0.01 TW wavelengths, except at its periphery where said surface radiator is close to said ground surface. (The TW wavelength here refers to the wavelength of the desired propagating TW.) At least one curvilinear dimension of the surface radiator is at least 0.1 TW wavelengths in extent in order to support a TW which radiates a desired antenna pattern via the array of slots. The surface radiator has a cluster of medial feed portion in the central region, which is connected to a cable that feeds the transmitter/receiver.

The impedance matching structure positioned between the surface radiator and the ground surface, and between said medial feed portion and the periphery of the surface radiator, effects the propagation of one or more modes of TW having a desired broadband radiating property with minimal reflection. A distributed reactive impedance matching network is positioned at the periphery of the surface radiator to effect the propagation of said TW onto the platform to achieve a desired broadband radiating property for the entire antenna/platform assembly with minimal reflection.

The surface radiator is derived from a planar broadband antenna, preferably the planar frequency-independent (FI) type, which is contoured, by bending and stretching, to a desired conformal surface. In other words, the surface radiator is a radial conformal projection, with its radial dimension preserved, from a truncated planar broadband or FI antenna to a curved surface conformal to the platform. (The radial dimension or distance is defined as the length measured outward from the center of the medial feed portion to a point on the surface radiator along its curvilinear surface.) The planar FI antennas have been well documented in the literature (DuHamel and Scherer, 1993; Mayes, 1988), which can be a log-periodic (LP) type, the self-complementary type, the sinuous type, etc.

The feed portion of the TW antenna comprises one or more pairs of transmission lines, which can support different radiation modes and/or dual-orthogonal or circular polarization. One or more layers of dielectric or magneto-dielectric substrates can be placed between the ground surface and the surface radiator, or as superstrate placed above the surface radiator, or both, to further reduce the size, or increase the bandwidth, in particular the lower bound of the bandwidth, of the antenna.

DETAILED DESCRIPTION OF THE INVENTION

The Physical Structure

Figure 1:
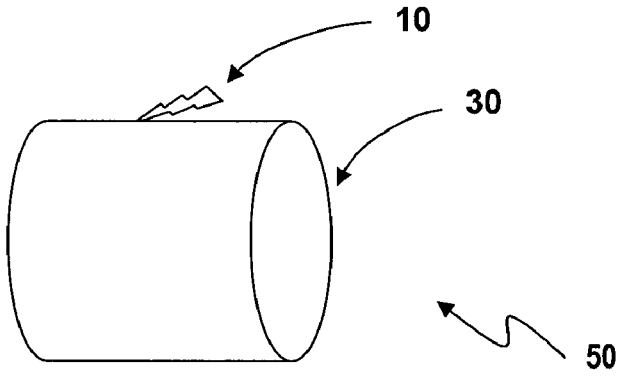
FIG. 1 is a plan view of an antenna mounted on a highly curved platform.

Referring now to FIG. 1 depicting an antenna 10 mounted on a platform 30, the antenna/platform assembly is collectively denoted as 50 in recognition of the inseparable interactions between the antenna 10 and its mounting platform 30, especially when the dimensions of the antenna are smaller than, say, ½ wavelength.

Figure 2A:
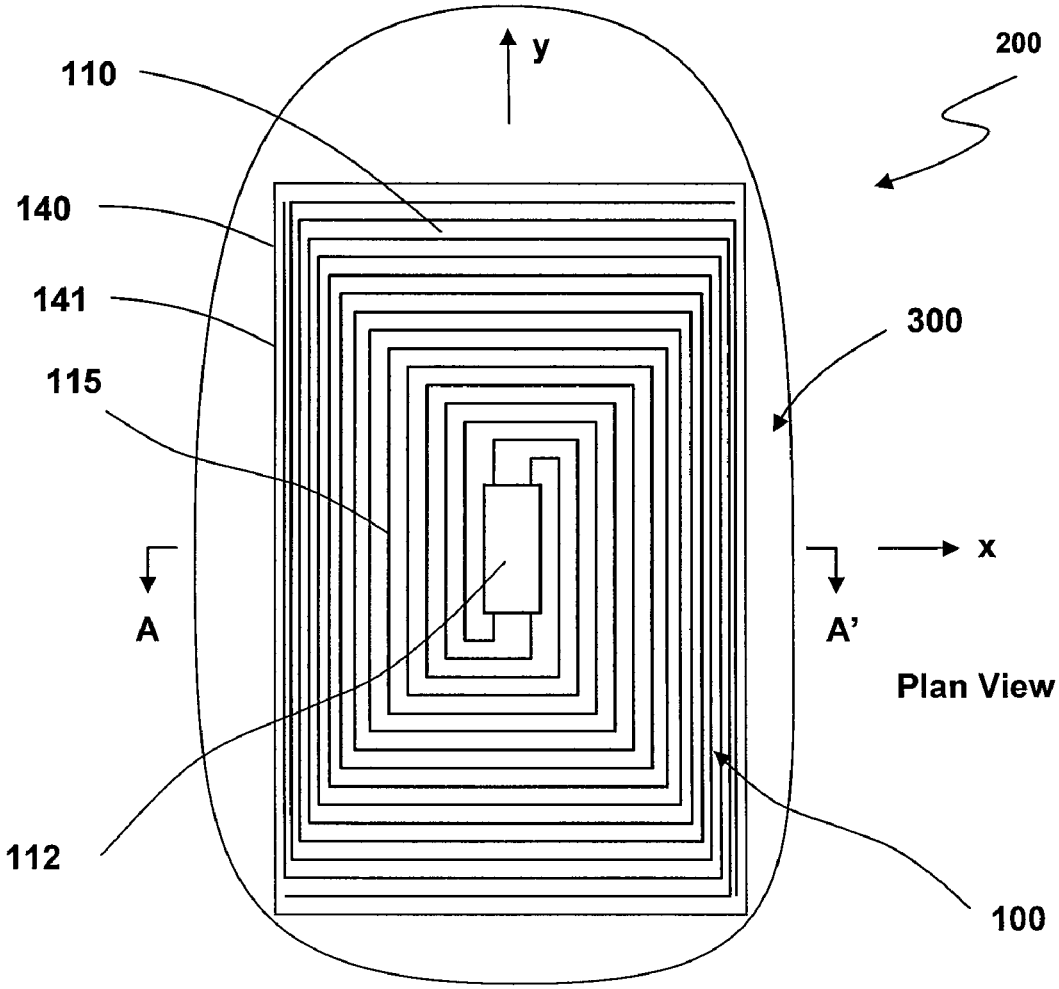
FIG. 2A is a plan view of a small conformal broadband TW antenna mounted on a highly curved platform.
Figure 2B:
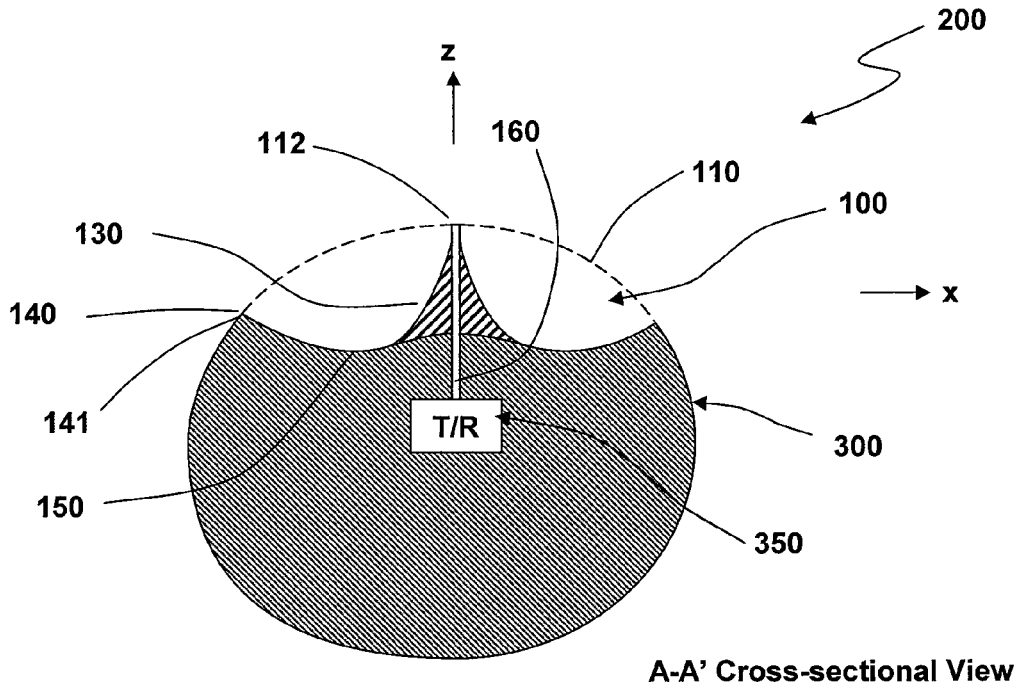
FIG. 2B is a cross-sectional view at A-A' plane for the antenna/platform shown in FIG. 2A.

In a preferred form of this invention, a conformable broadband traveling-wave (TW) antenna coupled with a platform is depicted in the plan view in FIG. 2A and a cross-sectional view in FIG. 2B at the A-A' plane of FIG. 2A. A broadband TW antenna 100 is conformally mounted on a platform 300, and as an integrated antenna/platform assembly 200. By conformal mounting it is generally meant that the antenna is a low-profile structure that can be integrated onto a platform with minimal intrusion and/or protrusion.

The broadband TW antenna 100 consists of a broadband TW surface radiator 110 positioned above and spaced from a conducting ground surface 150, both of which are generally curvilinear and conformable to the platform 300. The surface radiator 110 has a cluster of medial feed portion 112 in its central region and an array of slots 115 that supports a TW with a desired broadband radiating property. The surface radiator 110 is generally a curvilinear surface, positioned above and spaced from a conducting ground surface 150 more than 0.01 TW wavelengths apart, throughout its operating frequencies, except at its periphery 140, where it may be close to or in contact with ground surface 150.

Figure 2C:
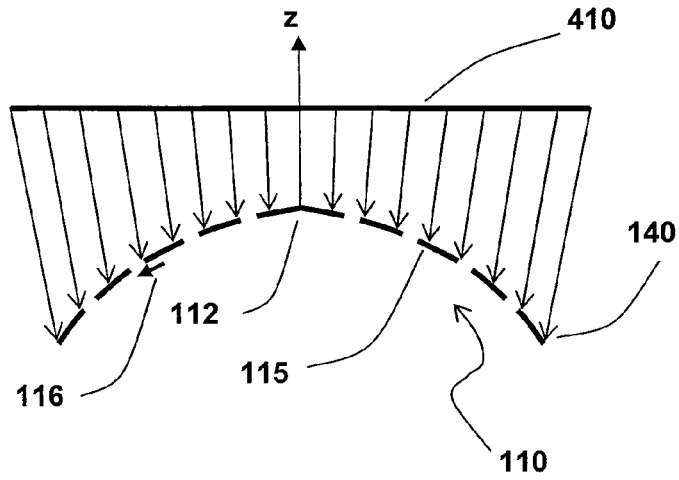
FIG. 2C illustrates the geometry of radial conformal projection from a planar structure to a curved surface with radial dimension preserved.

The lines depicting the surface radiator 110 denote symbolically conducting strips of a certain width, not explicitly illustrated in the plan view of FIG. 2A, which can be either constant or varying. The array of slots 115 is derived from a truncated planar antenna bent to conform to the curved surface of the platform. FIG. 2C shows, in one cross-section containing the z axis (that is, in a θ or θ-z plane in spherical coordinates), how the curved array of slots 115 is derived from a planar broadband antenna 410 shown in FIG. 3 by a radial conformal projection.

The radial conformal projection is defined here to be a projection of a two-dimensional (2D) planar configuration 410 to a three-dimensional (3D) surface structure 115 with the radial distance or dimension preserved. The radial distance or dimension is defined as the length measured outwardly from the center of the medial feed portion 112 (the z axis) to a point on the surface radiator 110 along its curvilinear surface. The radial distance or dimension can be obtained by a line integral from the z-axis outwardly along the curvilinear surface of the surface radiator 110 in the direction of a vector 116, as shown in FIG. 2C, which is parallel to both a fixed θ plane (formed by the z-axis and a fixed vector θ) in spherical coordinates and the surface tangent of the surface radiator along the path of the line integration. Although the surface of the surface radiator 110 is generally curvilinear, the design should minimize rapid variations in the vector 116 for smooth propagation of the TW.

If we imagine the process as the bending and stretching process that transforms a 2D planar antenna 410 to a 3D curved array of slots 115, the bending is in the radial dimension (or direction), and the stretching and shrinking are in the orthogonal dimension (or direction). In other words, the surface radiator is a radial conformal projection, which has minimal change in the conformal radial dimension, from a truncated planar broadband or FI antenna to a curved surface radiator conformal to the platform.

In FIG. 2A, the lines denoting the surface radiator 110 are 4-arm self-complementary spirals in which the width of metal strips and the spacings between them are equal (by the definition of "self complementary"), and is chosen for its radiation property as well as its support of a desired TW along the surface radiator 110. The array of slots 115 of the surface radiator 110 here is a planar shell of a 4-arm self-complementary spiral bent into a cylindrical arc in the x-z plane to conform to the cylindrical platform with no bending in the y-z plane, as shown in FIG. 2B.

One curvilinear dimension of surface radiator 110, in this case the y dimension, is at least 0.1 TW wavelengths in extent so as to support the prescribed TW which radiates a desired antenna pattern via said surface radiator. An impedance matching structure 130 is positioned between the medial feed portion 112, periphery 140 of the TW surface radiator 110, and the ground surface 150 to effect the propagation of said TW with minimal reflection.

The cluster of medial feed portion 112 in the central area of surface radiator 110 is a microwave circuit that excites the desired TW modes in the surface radiator 110 and also matches the input impedance of the surface radiator 110 and ground surface 150 on one side and the input impedance of the feed cable 160 on the other. The design of medial feed portion 112 follows the microwave theory in general and the theory on multiterminal planar antenna structures (Deschamps, 1959). The feed cable 160 can be a twin-lead transmission line for single mode operation, or a pair of twin-lead transmission lines for dual-mode operation. It can contain a balun, or a multiplexing circuit, which serves also as an impedance transformer between the balanced/unbalanced circuit architecture of the medial feed portion 112 and the input terminals of the transmitter/receiver (T/R) 350.

A distributed reactive impedance matching network 141 is positioned at the periphery of the surface radiator to effect the propagation of said TW onto the platform 300 with a desired broadband radiating property for the entire antenna/platform assembly with minimal reflection. A simple design for the distributed reactive impedance matching network 141 can be a set of very short (less than 1/100 wavelength) conducting wires, distributed around the periphery 140 of the surface radiator 110, connecting with the platform 300. General theory and techniques for the impedance matching structure 130 and the distributed impedance matching network 141 at periphery 140 for broadband impedance matching are well established in the field of microwave circuits, which can be adapted to the present application (e.g., an extensive treatise can be found in the book by Matthaei et al, 1964, reprinted 1985) and which may be needed for a more complex impedance-matching case or for a better broadband performance. It must be pointed out that the requirement of impedance matching must be met for each mode of TW, if there are two or more modes that are to be employed for multimode, multifunction, or pattern/polarization diversity operations by the antenna.

Figure 3:
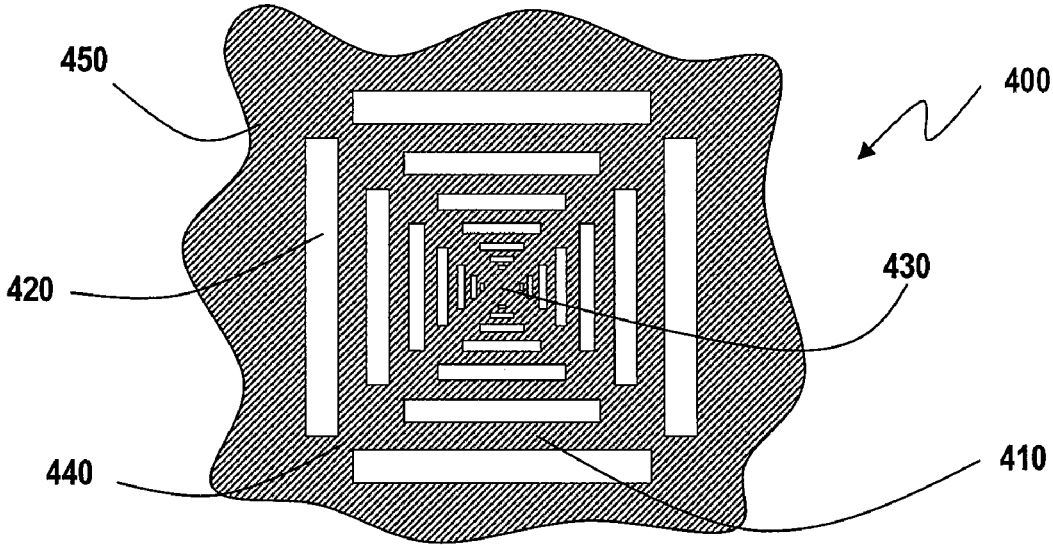
FIG. 3 is a planar broadband array of slots for the derivation of a surface radiator by radial conformal projection.

Since the radiation on the surface radiator is from the array of slots 115 formed by the multi-arm spiral, the surface radiator 410 as shown in FIG. 3 is probably one of the more general and representative configurations for this invention. Here a surface radiator 410 comprises an array of slots 420, a medial feed portion 430, and a distributed impedance matching network at periphery 440; the whole antenna/platform assembly is denoted as 400. Note, however, that the spiral structure in FIGS. 2A and 2B serves a convenient structure for the design of the cluster of medial feed portion 112 in the central area of the antenna for broadband excitation of single or multiple modes of TW. Note also that the four slots in each rectangular ring can be connected to form a rectangular annular slot so that the antenna becomes an array of annular slots. Each slot array element can be further subdivided to form an array of more elements.

Note that the surface radiator 410 in the form of array of slots shown in FIG. 3 is only a plan view of a broadband planar antenna, and that a radial conformal projection as shown in FIG. 2C must be performed in order to obtain the desired 3-dimensional surface radiator. Note also that, in the transformation, fidelity is maintained along at least one radial curvilinear coordinate originating from the center of the medial feed portion 430, to conform to the surface of the platform 450 when it is not possible to maintain radial fidelity for all θ or θ-z planes. Put in a more intuitive way, the surface radiator 410 can be constructed by starting with a planar 2-dimensional configuration, and then bend and stretch it to a curved surface, with fidelity in length preserved for at least one meridian (along the radial curvilinear coordinate originating from the center of the medial feed portion 430), and with the orthogonal dimensions necessarily distorted, in order to realize the ultimate conformal surface for the surface radiator 410.

Other versions for the surface radiator can be derived from any of the planar frequency-independent (FI) antennas as discussed in the literature (DuHamel and Scherer, 1993; Mayes, 1988), which can be a log-periodic (LP) type, the self-complementary type, the sinuous type, etc. For example, planar FI antenna 500 shown in FIG. 4A can be bent and stretched, by radial conformal projection, with fidelity maintained along at least one radial curvilinear coordinate originating from the center of the medial feed portion 520, and along surface radiator 510, to conform to the surface of a platform.

Figure 4A:
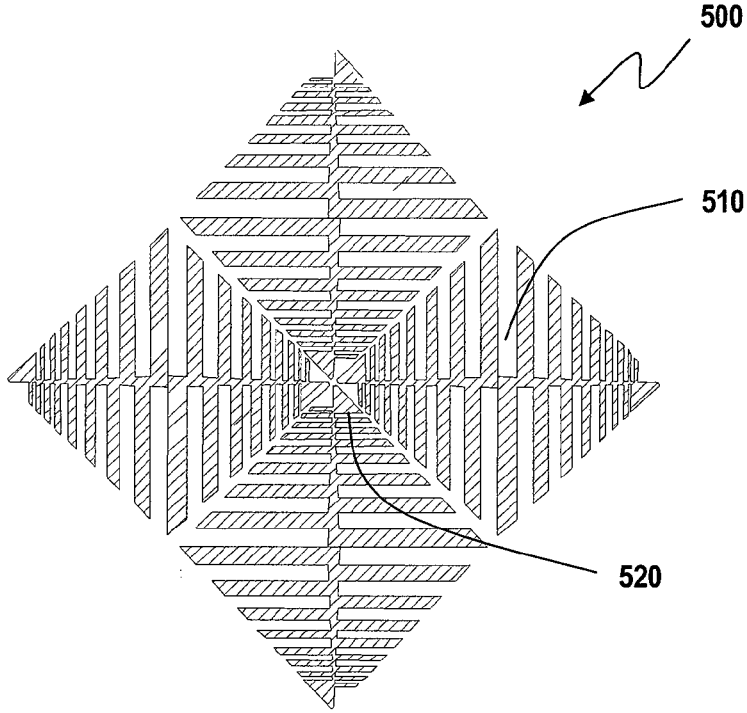
FIG. 4A is a square planar log-periodic array of slots for the derivation of a surface radiator by radial conformal projection.
Figure 4B:
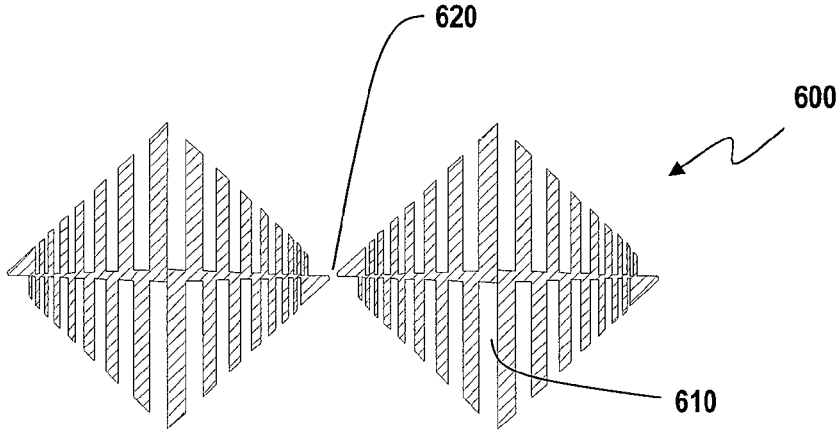
FIG. 4B is an elongated planar log-periodic array of slots for the derivation of a surface radiator by radial conformal projection.
Figure 5A:
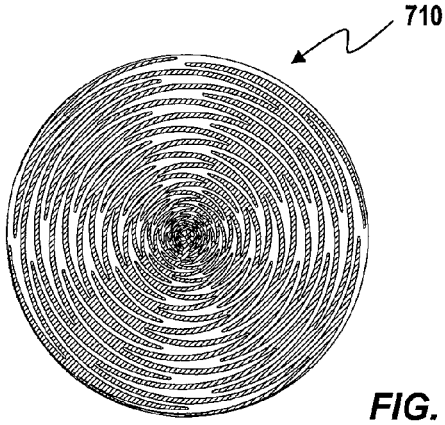
FIG. 5A is a circular planar sinuous array of slots for the derivation of a surface radiator by radial conformal projection.
Figure 5B:
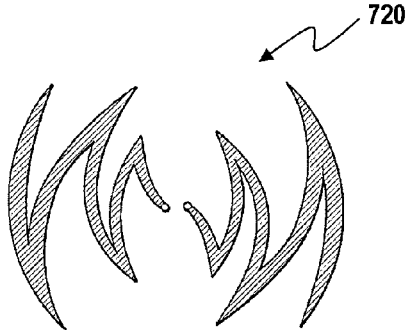
FIG. 5B is an elongated sinuous planar array of slots for the derivation of a surface radiator by radial conformal projection.
Figure 5C:
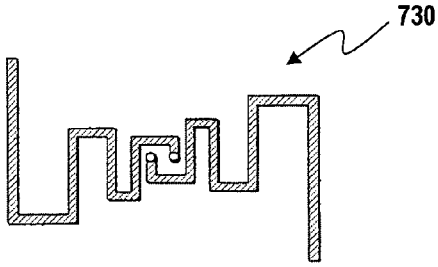
FIG. 5C is an elongated zigzag planar array of slots for the derivation of a surface radiator by radial conformal projection.
Figure 5D:
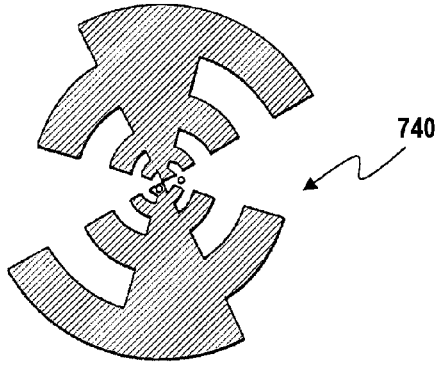
FIG. 5D is an elongated log-periodic self-complementary planar array of slots for the derivation of a surface radiator by radial conformal projection.

FIG. 4B shows an elongated planar FI antenna 600, which can be bent and stretched, like that in FIG. 4A, with fidelity maintained along at least one radial curvilinear coordinate originating from the center of the medial feed portion 620, and along surface radiator 610, to conform to the surface of the platform. The configuration in FIG. 4B is suitable for platforms on which the surface allocated for antenna mounting is in the shape of an elongated area, while that for FIG. 4A is in the shape of a rectangle.

The purpose of maintaining fidelity along at least one radial curvilinear coordinate originating from the center of the medial feed portion is to enable the TW to propagate along this radial direction with minimal reflection. For example, in the case of the cylindrical arc shell form of surface radiator 110 as shown in FIGS. 2A and 2B, the major radial coordinate is parallel to the y axis.

FIGS. 5A, 5B, 5C, 5D show other planar FI TW element antennas, which can be employed to form surface radiators 710, 720, 730, and 740 by radial conformal projection.

Theoretical Basis of the Invention

It is noted that prior-art approaches for broadband conformal antennas are for mounting on a largely planar surface area, which has a large radius of curvature, of a platform. The theory of these antennas stems from the frequency-independent (FI) planar antennas (DuHamel and Scherer, 1993; Mayes, 1988) and the innovation later to judiciously add a backing conducting ground plane to make them suitable for conformal mounting on a largely planar surface area on a platform (Wang and Tripp, 1991; Wang and Tripp, 1994; Wang and Tillery, 2000).

Without loss of generality, the theory of operation for the present invention can be explained by considering the case of transmit; the case of receive is similar on the basis of reciprocity. Referring to FIGS. 2A and 2B, a traveling wave (TW) is launched at the feed portion 112 of the conformal broadband TW antenna 100, and propagates radially outwardly from the z axis toward its periphery 140. While the TW propagates radially along the curvilinear surface radiator 110, radiation takes place from the array of slots 115 which are in proper phase relationship for the desired radiation pattern. The TW propagates radially outwardly from the z axis with minimal reflection by a properly designed impedance matching structure 130 placed between surface radiator 110 and ground surface 150, and coupled to the platform 300 via the distributed impedance matching network 141 at periphery 140. Impedance matching is crucial to the performance of the antenna, and must be achieved over the broad bandwidth from the feed portion 112 to periphery 140 and then to the mounting platform 300. General impedance matching techniques for multi-stage transmission lines and waveguides are in the literature (e.g., Matthaei et al, 1964, reprinted 1985).

Figure 6:
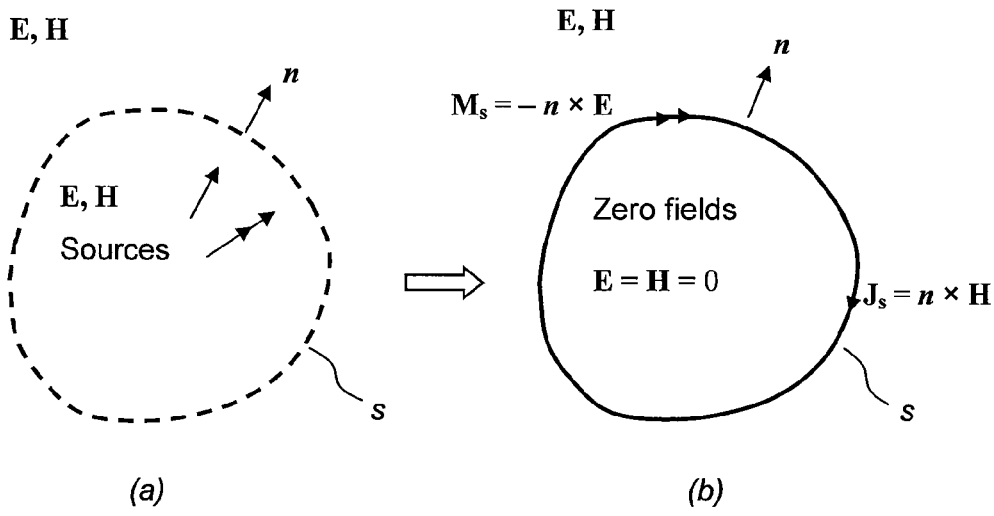
FIG. 6 shows the equivalence for fields outside a closed surface S between: (a) sources inside S and (b) equivalent electrical and magnetic surface currents on S.

Discussions on the traveling-wave antennas in general can be found in Walter (1965). The radiation of the present electrically small broadband conformal TW antenna on platform is discussed as follows (Wang, 1991, pp. 103-105 and 165-175). FIG. 6 shows that, by invoking the equivalence principle, the original problem of the antenna/platform assembly, depicted in (a), is equivalent to that of (b) as far as the exterior fields are concerned. S in FIG. 6 is a closed surface enclosing the antenna/platform assembly, and is chosen to be infinitesimally close to the antenna/platform assembly.

The time-harmonic electric and magnetic fields, E and H, outside the closed surface S can be represented as those due to the equivalent electric and magnetic currents, $J_s$ and $M_s$, on the surface S given by $$M_s=-n\times E \text{ on S} \tag{1a}$$

$$J_s=n\times H \text{ on S} \tag{1b}$$

The electromagnetic fields outside the closed surface S is given by $$H(r)=\int_S[-j\omega\in_o M_s(r')g+J_s(r')\times\nabla'g+1/j\omega\mu_o\nabla s'\cdot M_s(r')\nabla'g]ds' \text{ outside S} \tag{2}$$

where g is the free-space Green's function given by $$g=g(r,r')=\frac{e^{-jk|r-r'|}}{4\pi|r-r'|} \tag{3}$$

$k=2\pi/\lambda$; where λ is the wavelength of the TW. η is the free-space wave impedance equal to $\sqrt{\mu_o/\in_o}$ or 120π, $\in_o$ and $\mu_o$ are the free-space permittivity and permeability, respectively. And $\omega=2\pi f$, where f is the frequency of interest.

The unprimed and primed (') position vectors, r and r', with magnitudes r and r', respectively, refer to field and source points, respectively, in the source and field coordinates. (All the "primed" symbols refer to the source.) The symbol $\nabla_s'$ denotes a surface gradient operator with respect to the primed (') coordinate system, and $\hat{r}$ represents a unit vector in the direction of the field position vector r.

For the present TW antenna consisting of an array of slots, the region of the surface radiator is fully represented by the equivalent magnetic surface current $M_s$. As for the region over the surface of the platform, there is only an equivalent electric surface current $J_s$ if the platform surface is conducting. For the surface area on the platform that is nonconducting, both electric and magnetic equivalent surface currents, $J_s$ and $M_s$, generally exist.

The time-harmonic magnetic field in the far zone is given by $$E(r)=-\eta\hat{r}\times H(r) \text{ in the far zone} \tag{4}$$

Note here that the sources, fields, and the Green's function involved here, according to Eqs. (1) through (4), are all complex vector quantities. Therefore, radiation will be effective only if the integrand in Eq. (2) is substantially in phase; and the radiation must also yield a useful radiation pattern. For maximum radiation desired, good impedance matching is essential. Based on antenna theory, and specialized to the present problem in Eqs. (2) and (3), a useful antenna radiation pattern is directly related to its source currents. Therefore, it is advantageous to design the broadband planar array from known broadband antenna configurations, rather than by random approaches.

Figure 7:
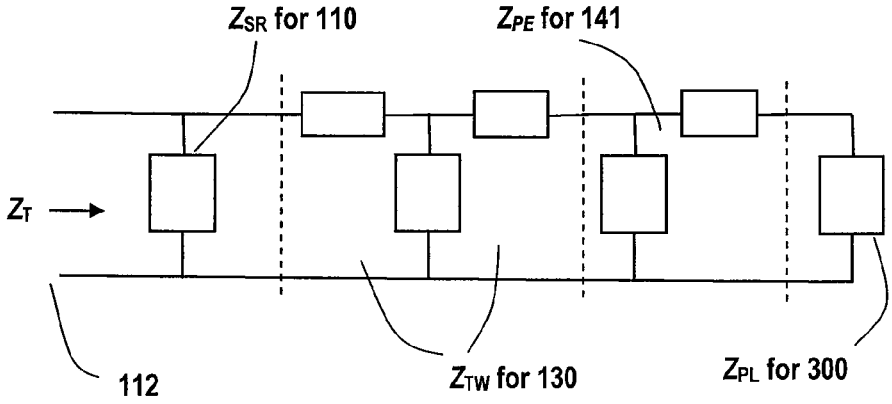
FIG. 7 shows an equivalent circuit for the TW antenna and platform.

FIG. 7 shows an equivalent circuit for the TW antenna structure 100, from the array element feed terminals cluster of medial feed portion 112 in the central area of surface radiator 110 to the impedance matching network at periphery 140. The input impedance $Z_T$, as viewed from the medial feed portion 112, can be divided into three sections of transmission line, each containing an equivalent lumped impedance.

First, there is the impedance $Z_{SR}$, representing the surface radiator 110. The next stage is the impedance $Z_{TW}$ in the form of a T junction, representing the impedance matching structure 130. The third stage is the distributed impedance matching network $Z_{PE}$ 141 in the form of an L network at the periphery region 140 of the surface radiator 110. The final stage, the platform 300, is represented by the impedance $Z_{PL}$. The input impedance $Z_T$ is to match the feed cable 160 by the impedance matching structure 130, or $Z_{TW}$, and the distributed impedance matching network 141, or $Z_{PE}$.

VARIATION AND ALTERNATIVE FORMS OF THE INVENTION

Although the configurations for the surface radiators are, or are derived from, the planar FI antennas shown in FIGS. 2 through 5 using a radial conformal projection, other planar antennas and other projections are alternative forms of this invention as long as they can support a TW wave with minimal reflection and have the desired radiation property.

The invention claimed is:

1. An electrically small broadband traveling-wave (TW) antenna conformable to a curved platform comprising:

a conducting ground surface generally curvilinear and conformal to said platform;

a broadband traveling-wave surface radiator consisting of an array of slots, a cluster of medial feed portion for connection between said array of slots and a cable feeding a transmitter/receiver; said surface radiator being generally curvilinear and spaced apart from said ground surface more than 0.01 operating TW wavelength, except at its periphery where said surface radiator is close to said ground surface; one curvilinear dimension of said surface radiator being at least 0.1 TW wavelength in extent in order to support said traveling wave which radiates a desired antenna pattern via said array of slots;

an impedance matching structure positioned between said surface radiator and said conducting ground surface, with one end near said medial feed portion, to effect the propagation of a TW with a desired broadband radiating property with minimal reflection; and a distributed impedance matching network positioned on the periphery of said surface radiator to strongly couple the antenna to the platform, effecting the propagation of said traveling wave onto said platform with a desired broadband radiating property with minimal reflection at the lower operating frequencies of said antenna.

2. The broadband traveling-wave antenna and platform assembly of claim 1 in which the surface of the platform under and near the antenna is largely conductive and the ground surface merges electrically with the platform.

3. A broadband traveling-wave antenna according to claim 1 wherein the broadband traveling-wave surface radiator is molded from a planar frequency-independent antenna by a radial conformal projection to a contour conformal to the platform.

4. A broadband traveling-wave antenna according to claim 1 wherein the broadband traveling-wave surface radiator is molded from a planar self-complementary antenna by a radial conformal projection to a contour conformal to the platform.

5. An electrically small broadband traveling-wave (TW) antenna conformable to a curved platform comprising:

a conducting ground surface generally curvilinear and conformal to said platform;

a broadband traveling-wave surface radiator consisting of an array of slots, a cluster of medial feed portion for connection between said array of slots and a cable feeding a transmitter/receiver; said surface radiator being generally curvilinear and spaced apart from said ground surface more than 0.01 operating TW wavelength, except at its periphery where said surface radiator is close to said ground surface; one curvilinear dimension of said surface radiator being at least 0.1 TW wavelength in extent in order to support said traveling wave which radiates a desired antenna pattern via said array of slots;

an impedance matching structure positioned between said surface radiator and said conducting ground surface, with one end near said medial feed portion, to effect the propagation of a TW with a desired broadband radiating property with minimal reflection;

a distributed impedance matching network positioned on the periphery of said surface radiator to strongly couple the antenna to the platform, effecting the propagation of said traveling wave onto said platform with a desired broadband radiating property with minimal reflection at the lower operating frequencies of said antenna; and layers of dielectric or magneto-dielectric substrates positioned between said surface radiator and ground surface, and layers of dielectric or magneto-dielectric superstrates positioned conformally above said surface radiator.

6. The broadband traveling-wave antenna and platform assembly of claim 5 in which the surface of the platform under and near the antenna is largely conductive and the ground surface merges electrically with the platform.

7. A broadband traveling-wave antenna according to claim 5 wherein the broadband traveling-wave surface radiator is molded from a planar frequency-independent antenna by a radial conformal projection to a contour conformal to the platform.

8. A broadband traveling-wave antenna according to claim 5 wherein the broadband traveling-wave surface radiator is molded from a planar self-complementary antenna by a radial conformal projection to a contour conformal to the platform.

9. An electrically small broadband traveling-wave (TW) antenna conformable to a curved platform comprising:

a conducting ground surface generally curvilinear and conformal to said platform;

a broadband traveling-wave surface radiator consisting of an array of slots, a cluster of medial feed portion for connection between said array of slots and a cable feeding a transmitter/receiver; said surface radiator being generally curvilinear and spaced apart from said ground surface more than 0.01 operating TW wavelength, except at its periphery where said surface radiator is close to said ground surface; one curvilinear dimension of said surface radiator being at least 0.1 TW wavelength in extent in order to support two or more modes of traveling wave which radiates two or more desired antenna patterns via said array of slots;

an impedance matching structure positioned between said surface radiator and said conducting ground surface, with one end near said medial feed portion, to effect the propagation of said modes of traveling wave with desired broadband radiating property and minimal reflection;

a distributed impedance matching network positioned on the periphery of said surface radiator to strongly couple the antenna to the platform, effecting the propagation of said modes of TW onto said platform with a desired broadband radiating property and minimal reflection at the lower operating frequencies of said antenna; and layers of dielectric or magneto-dielectric substrates positioned between said surface radiator and ground surface, and layers of dielectric or magneto-dielectric superstrates positioned conformally above said surface radiator.

10. The broadband traveling-wave antenna and platform assembly of claim 9 in which the surface of the platform under and near the antenna is largely conductive and the ground surface merges electrically with the platform.

11. A broadband traveling-wave antenna according to claim 9 wherein the broadband traveling-wave surface radiator is molded from a planar frequency-independent antenna by a radial conformal projection to a contour conformal to the platform.

12. A broadband traveling-wave antenna according to claim 9 wherein the broadband traveling-wave surface radiator is molded from a planar self-complementary antenna by a radial conformal projection to a contour conformal to the platform.

* * * * *